US005360139A

United States Patent [19]

Goode

[11] Patent Number: 5,360,139

[45] Date of Patent: Nov. 1, 1994

[54] LIQUIFIED NATURAL GAS FUELING FACILITY

[75] Inventor: John E. Goode, Arlington, Tex.

[73] Assignee: Hydra Rig, Inc., Fort Worth, Tex.

[21] Appl. No.: 7,540

[22] Filed: Jan. 22, 1993

[51] Int. Cl.[5] ..... B67D 5/378

[52] U.S. Cl. ..... 222/40; 62/50.1; 62/50.6; 222/1; 222/54; 222/61; 222/64; 222/71; 222/318; 239/125; 239/132; 239/132.5

[58] Field of Search ..... 222/1, 23, 40, 54, 61, 222/64, 71, 318; 239/125, 132, 132.5; 62/50.1, 50.4, 50.6, 50.7, 53.2

[56] References Cited

U.S. PATENT DOCUMENTS

| | | | |
|---|---|---|---|
| 2,061,013 | 11/1936 | Wade | 222/318 X |
| 3,235,129 | 2/1966 | Kruckeberg | 222/318 X |
| 3,418,822 | 12/1968 | Massey | 62/50.1 |
| 3,733,838 | 5/1973 | Delahunty | 62/50.1 X |
| 3,831,811 | 8/1974 | Becker | 222/61 X |
| 4,898,217 | 2/1990 | Corbo et al. | 222/56 X |
| 4,947,651 | 8/1990 | Neeser et al. | 62/50.4 |
| 5,121,609 | 6/1992 | Cleslukowski | 62/50.4 |
| 5,127,230 | 7/1992 | Neeser et al. | 62/7 |
| 5,136,852 | 8/1992 | Neeser et al. | 62/50.4 |
| 5,163,409 | 11/1992 | Gustafson et al. | 123/525 |
| 5,214,925 | 6/1993 | Hoy et al. | 62/50.1 X |
| 5,228,295 | 7/1993 | Gustafson | 62/50.1 X |
| 5,228,585 | 7/1993 | Lutgen et al. | 220/4.14 |
| 5,228,594 | 7/1993 | Aslin | 222/318 X |
| 5,231,838 | 8/1993 | Cleslukowski | 62/50.4 |

FOREIGN PATENT DOCUMENTS 0281927 11/1988 Japan ..... 222/64

*Primary Examiner*—Andres Kashnikow
*Assistant Examiner*—Joseph A. Kaufman
*Attorney, Agent, or Firm*—Marc A. Hubbard

[57] ABSTRACT

An automated fueling facility allows untrained persons to safely dispense homogenous phase liquid methane from a cryogenic storage tank into a motor vehicle. The fueling facility automatically maintains pressure on the liquid methane within a predetermined safe operating range using methane gas trapped in the cryogenic storage tank. The pressure on the liquid methane is at least set equal to a set pressure equal to the sum of the saturation pressure of the liquid methane plus an additional amount to help to ensure that it remains in a fully saturated condition after absorbing any heat during pumping from the storage tank. A pump is cooled by placing it in the storage tank and circulating liquid methane through the pump and back into the storage tank. A dispenser, including nozzle for connecting to a motor vehicle, is cooled by circulating liquid through the nozzle and back to the storage tank through a receptacle on the dispenser to which the nozzle is connected. No dispensing of liquid methane into a motor vehicle tank is allowed to begin without the pressure of the liquid methane being within the operating range and the pump and nozzle pre-cooled. No additional pressure is built in the storage tank than is necessary to bring the pressure of the liquid methane to the set pressure.

23 Claims, 8 Drawing Sheets

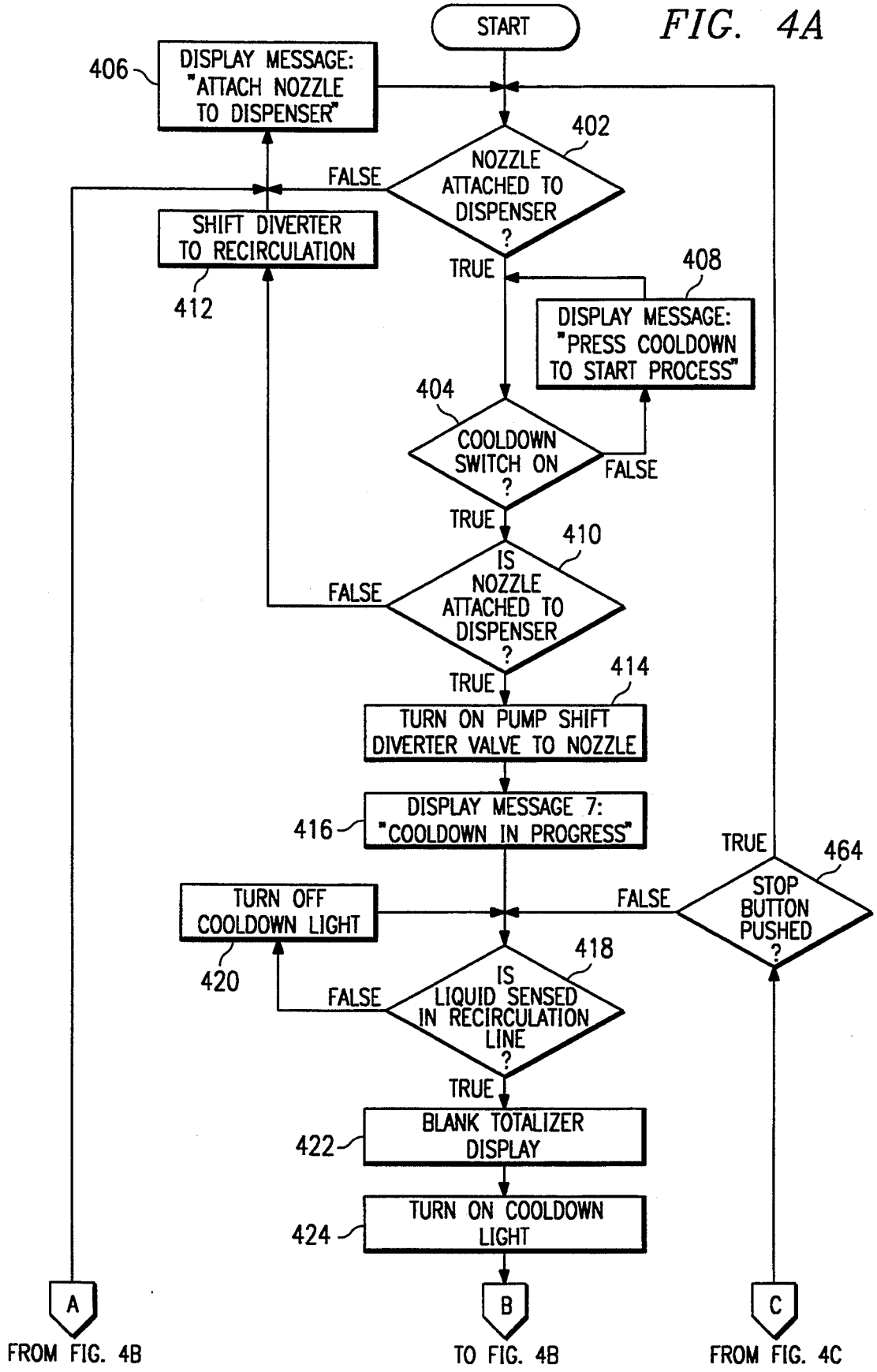
FIG. 4A
START
406
DISPLAY MESSAGE: "ATTACH NOZZLE TO DISPENSER"
402
NOZZLE ATTACHED TO DISPENSER ?
FALSE
SHIFT DIVERTER TO RECIRCULATION
412
TRUE
408
DISPLAY MESSAGE: "PRESS COOLDOWN TO START PROCESS"
404
COOLDOWN SWITCH ON ?
FALSE
TRUE
410
IS NOZZLE ATTACHED TO DISPENSER ?
FALSE
TRUE
414
TURN ON PUMP SHIFT DIVERTER VALVE TO NOZZLE
416
DISPLAY MESSAGE 7: "COOLDOWN IN PROGRESS"
TRUE
464
STOP BUTTON PUSHED ?
FALSE
TURN OFF COOLDOWN LIGHT
420
418
IS LIQUID SENSED IN RECIRCULATION LINE ?
FALSE
TRUE
422
BLANK TOTALIZER DISPLAY
424
TURN ON COOLDOWN LIGHT
A
FROM FIG. 4B
B
TO FIG. 4B
C
FROM FIG. 4C

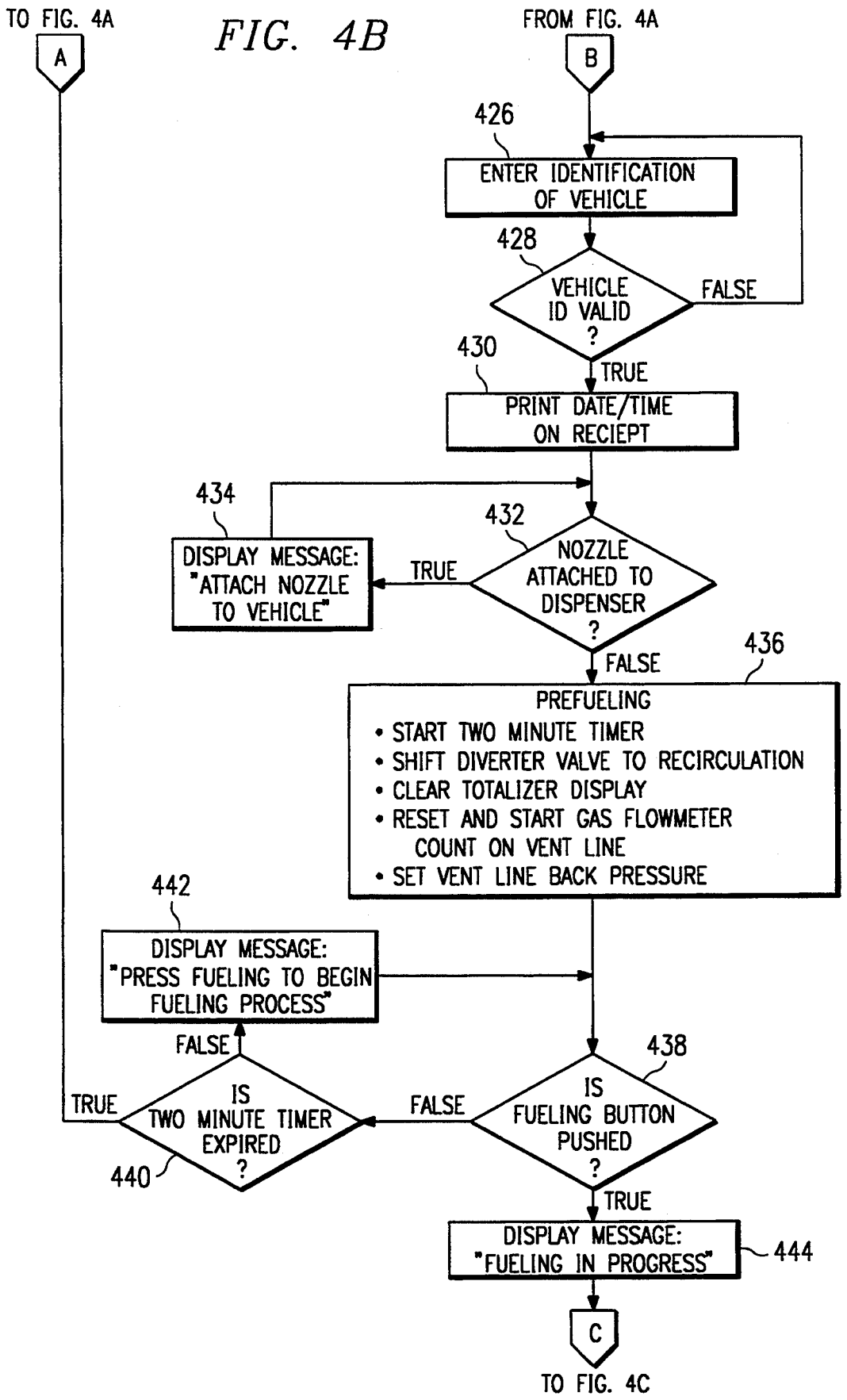
FIG. 4B
TO FIG. 4A
A
FROM FIG. 4A
B
426
ENTER IDENTIFICATION OF VEHICLE
428
VEHICLE ID VALID ?
FALSE
TRUE
430
PRINT DATE/TIME ON RECIEPT
434
DISPLAY MESSAGE: "ATTACH NOZZLE TO VEHICLE"
TRUE
432
NOZZLE ATTACHED TO DISPENSER ?
FALSE
436
PREFUELING
• START TWO MINUTE TIMER
• SHIFT DIVERTER VALVE TO RECIRCULATION
• CLEAR TOTALIZER DISPLAY
• RESET AND START GAS FLOWMETER COUNT ON VENT LINE
• SET VENT LINE BACK PRESSURE
442
DISPLAY MESSAGE: "PRESS FUELING TO BEGIN FUELING PROCESS"
FALSE
TRUE
IS TWO MINUTE TIMER EXPIRED ?
440
FALSE
438
IS FUELING BUTTON PUSHED ?
TRUE
DISPLAY MESSAGE: "FUELING IN PROGRESS"
444
C
TO FIG. 4C

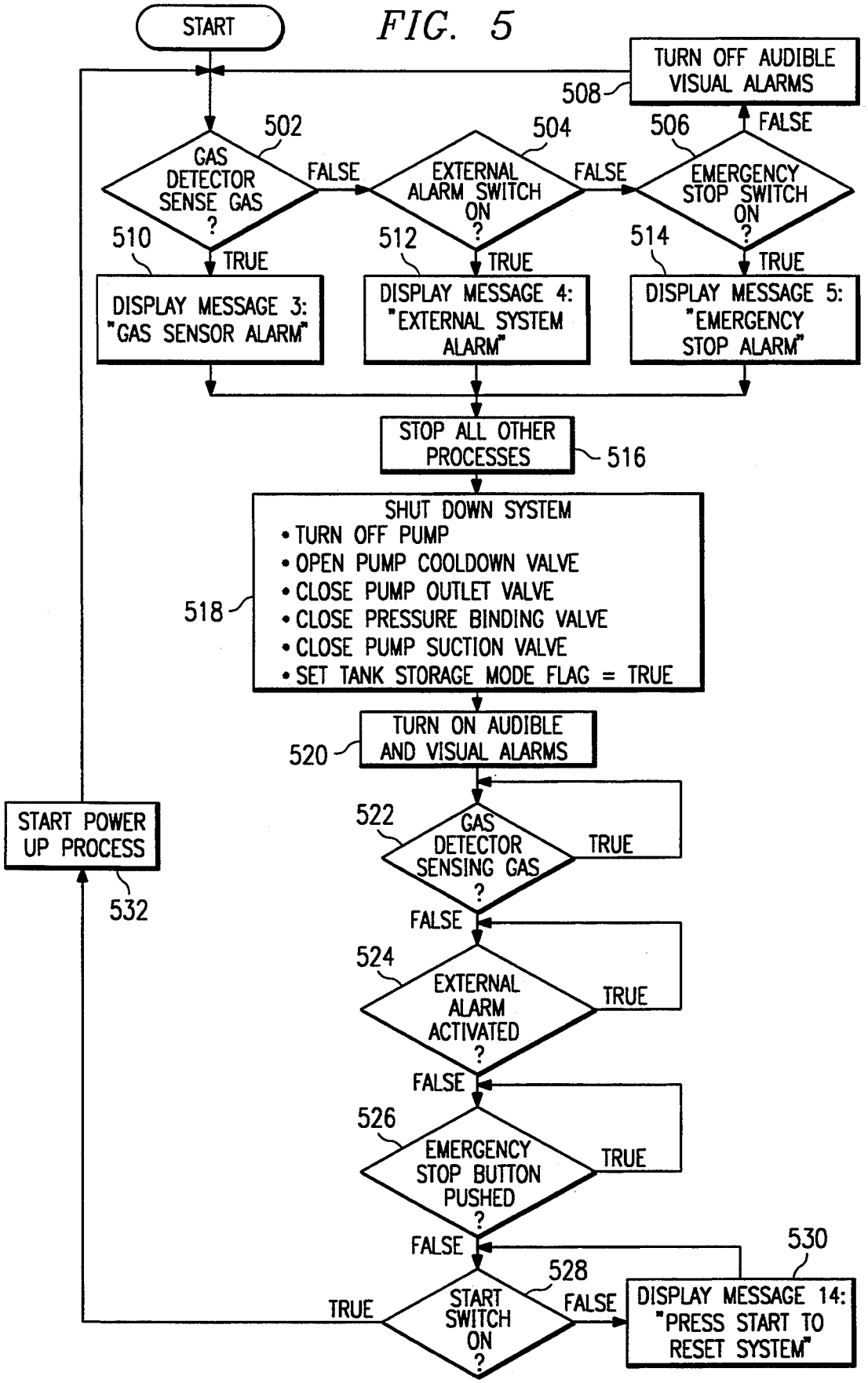
FIG. 5
START
TURN OFF AUDIBLE VISUAL ALARMS
508
502
504
506
FALSE
GAS DETECTOR SENSE GAS ?
FALSE
EXTERNAL ALARM SWITCH ON ?
FALSE
EMERGENCY STOP SWITCH ON ?
510
512
514
TRUE
TRUE
TRUE
DISPLAY MESSAGE 3: "GAS SENSOR ALARM"
DISPLAY MESSAGE 4: "EXTERNAL SYSTEM ALARM"
DISPLAY MESSAGE 5: "EMERGENCY STOP ALARM"
STOP ALL OTHER PROCESSES
516
SHUT DOWN SYSTEM
• TURN OFF PUMP
• OPEN PUMP COOLDOWN VALVE
• CLOSE PUMP OUTLET VALVE
• CLOSE PRESSURE BINDING VALVE
• CLOSE PUMP SUCTION VALVE
• SET TANK STORAGE MODE FLAG = TRUE
518
TURN ON AUDIBLE AND VISUAL ALARMS
520
START POWER UP PROCESS
532
522
GAS DETECTOR SENSING GAS ?
TRUE
FALSE
524
EXTERNAL ALARM ACTIVATED ?
TRUE
FALSE
526
EMERGENCY STOP BUTTON PUSHED ?
TRUE
FALSE
530
528
TRUE
START SWITCH ON ?
FALSE
DISPLAY MESSAGE 14: "PRESS START TO RESET SYSTEM"

LIQUIFIED NATURAL GAS FUELING FACILITY

FIELD OF THE INVENTION

The invention pertains generally to handling of cryogenic fluids, particularly liquid methane or natural gas; and more particularly, to facilities for fueling motor vehicles with liquid methane and to control systems for allowing untrained people to refuel motor vehicles with liquid methane.

BACKGROUND OF THE INVENTION

Interest in the use of liquid methane, frequently referred to as liquified natural gas (LNG), as a motor vehicle fuel has increased dramatically in recent years. Entire fleets of government and industry vehicles have successfully been convened to natural gas, and some privately-owned vehicles have been converted as well. Congress recently passed an energy bill which would require further increased use of alternative fuels in government and private fleets.

Several factors have influenced this increasing interest in natural gas as a motor vehicle fuel. LNG is relatively inexpensive. It also bums very cleanly, making it much easier for fleets to meet more restrictive pollution emission standards. However, handling LNG remains a significant problem.

An LNG fueling facility typically includes a massive LNG storage tank and a dispensing system. The dispensing system usually relies on a pump to deliver LNG from the massive storage tank to the vehicle. Refrigeration is very expensive. Therefore, insulation around the massive LNG storage tank is relied on exclusively in most installations to maintain methane in a liquid state. Storing and dispensing LNG from an insulated tank poses several problems.

LNG is preferably kept in a saturated state in the massive storage tank and as it is pumped through the dispensing system. Otherwise, heterogeneous phase methane is dispensed into a vehicle, which is undesirable. First, a vehicle's tank is only partially filled with usable fuel, reducing the range of the vehicle. The time between vehicle refuelings falls and this places an increased burden on the limited capacity of an LNG fueling facility to service a fleet. And second, obtaining an accurate measure of the amount of LNG actually dispensed into a vehicle's tank is not possible using conventional mass flow meters. The LNG fueling facility therefore cannot accurately charge for the LNG dispensed, which is especially important for facilities intended to service multiple fleets or individual consumers.

Pressure within the massive storage tank must also be kept below a maximum allowed pressure for safety. It is physically impossible to insulate a tank for no heat transfer. Therefore, heat from the environment continually warms the liquid methane. Once the temperature of the liquid methane rises above its saturation temperature the pressure under which the liquid is placed, the liquid methane boils, trapping the vapor in the tank. The liquid methane continues to boil off vapor, raising the pressure in the tank until of the pressure on the liquid methane reaches saturation pressure for the temperature of the liquid. Additional volume made available from to dispensing of LNG relieves some pressure. However, if the pressure within the tank meets or exceeds a maximum safe pressure, it must be vented in a procedure colloquially referred to as "blowing down the tank".

Blowing down a tank is undesirable. Releasing methane into the atmosphere can create a potential for explosion and is an environmental hazard. Although conditions which surround venting can be carefully controlled to minimize risks, releasing methane into the atmosphere is preferably avoided.

More importantly, taking the pressure off the liquid may lower its saturation temperature below its actual temperature, causing the liquid to boil. Blowing down the tank thus results in boiling, with the methane coming out of a homogenous liquid phase and assuming a heterogeneous phase. Blowing down the tank, however, dispels heat from the tank and results in lowering the liquid temperature. Less pressure is thus required to maintain the methane in a saturated liquid phase after blow down. Nevertheless, it is still desirable to slightly "sub-cool" the liquid methane by passing some liquid through a heat exchanger to vaporize it and returning the vapor back to the tank to pressurize and compress the liquid to raise its saturation temperature. Thus, some heat is returned to the gas occupying the void in the tank above the liquid level.

Specially trained operators are usually required to maintain the facility and to dispense the LNG. Having to employ specially trained operators to handle the LNG and cryogenic fluids not only makes LNG fueling stations more costly, it also makes them generally less appealing to fleet operators and particularly unappealing to average drivers who service their own automobiles. However, even specially trained operators are sometimes unable to properly condition the tank.

SUMMARY OF THE INVENTION

The invention, briefly stated, relates to a facility for dispensing cryogenic fluid having an intelligent or automated control system. The facility automatically conditions the tank and controls the dispensing process to help assure that untrained persons are able to safely dispense cryogenic fluid in a homogeneous phase while minimizing the use of venting of the massive storage tank. One important advantage of the invention is, consequently, that untrained persons may safely dispense homogeneous phase LNG while minimizing or possibly eliminating venting of methane gas. Thus, the invention make LNG a more viable fuel source for use by smaller fleets and by individual consumers.

The automated fueling facility has several inventive aspects and advantages, a few of which are summarized below in terms of its preferred embodiment, and others of which are described in or apparent from the detailed description of the preferred embodiment illustrated in the accompanying drawings. The following summary is, therefore, for purposes of illustrating and explaining various important aspects and advantages which comprise the invention, and is in no way intended to limit the scope of what is claimed as the invention.

The preferred embodiment includes, in addition to a massive storage tank, a pump and dispensing system, a programmable controller that receives data concerning the state of the methane in the tank and the dispensing process and then controls elements of a tank conditioning system and the dispensing system.

When dispensing is required, the controller brings LNG in the tank into condition for dispensing by bringing the pressure of the liquid at the pump's inlet to a set pressure. The set pressure is the minimum temperature at which fueling is permitted to take place in order to assure that homogenous liquid phase methane is pumped to the dispenser. To determine set pressure, the temperature of the LNG near the pump inlet is read and the liquid's saturation pressure is looked-up based on the temperature of the LNG. The set pressure is then set equal to the liquid saturation pressure at the read temperature plus an additional amount. The additional amount is, referred to as compression, raises the saturation temperature of the LNG to compensates for pressure losses and heat collected in a pipeline between the storage tank and the pump and thus assure that the liquid is at a minimum net positive suction head. The new positive suction head is necessary to prevent the pump, a centrifugal pump, from cavitating by drawing on the liquid and causing the liquid to flash or vaporize. The compression thus reduces the opportunity for flashing as the LNG is pumped out of the tank. Pressure is automatically built, if necessary, before dispensing is allowed. However, only enough pressure is built to compress the LNG to the set pressure, as any additional pressurization constitutes heat added to the tank.

To further reduce the possibility of flashing during fueling, the pump is submerged in the LNG and, when there is no fueling taking place, LNG is circulated through the pump and back to the top of the massive storage tank to cool the pump and reduce the possibility of the LNG flashing during fueling.

A dispensing nozzle and its associated plumbing, used to connect a flow of LNG to a vehicle's fuel tank, is also pre-cooled immediately prior to fueling to help prevent flashing as the LNG passes through the nozzle. The dispensing nozzle and its associated plumbing is pre-cooled by placing the nozzle on the dispenser equipped with a receptacle. Fueling is not permitted until the nozzle is pre-cooled. LNG is pumped through the nozzle and back to the LNG fueling trunk through the dispenser's receptacle. Once the LNG is pumped through the nozzle, the user is prompted to connect the nozzle to the vehicle and to push a fueling button when it is connected. While the nozzle is in the air, LNG continues to be pumped, but is momentarily diverted directly away from the nozzle and directly back to the storage tank. The time in which to connect the nozzle is limited to prevent the nozzle from becoming too warm. If too much time is taken, the nozzle must be reattached to the dispenser and pre-cooling repeated. Fueling is automatically stopped when liquid is sensed in the vent line from the vehicle's fuel tank to prevent damage to the gas flow meter in the vent line and waste of LNG. The gas flow meter measures the amount of methane gas released from the tank during fueling and subtracts it from the amount of LNG dispensed to keep an accurate count.

The controller automatically maintains compression on the LNG in a safe range, between the set pressure and a maximum safe operating pressure, that assures that homogeneous phase LNG is pumped from the tank. If the pressure in the storage tank exceeds the maximum safe pressure, the controller determines whether the liquid methane is "sub-cooled" or compressed beyond that necessary to assure dispensing homogeneous phase mixture. If this extra cooling is available, liquid methane is circulated and dispensed into the top of the cryogenic tank to cool the methane vapor at the top of the tank, which "collapses" pressure. Once the sub-cooling or compression is reduced to that required for normal operation, a pressure blow-down valve is automatically opened when the pressure reaches the maximum pressure limit. Fueling is prevented from taking place during blow-down. After blowdown, the LNG is automatically returned to a sub-cooled condition by building pressure in the tank and compressing the LNG to a new set pressure determined based on the actual temperature of the liquid.

During filling of the cryogenic tank, the controller automatically diverts LNG from a tanker truck between a "top" fill and a "bottom" fill as necessary to avoid venting of methane vapor. Generally, the liquid methane from the tanker truck is sub-cooled, as it is compressed in the tanker. This sub-cooling is preferably retained so that it is useful for collapsing pressure buildup during dispensing. Additionally, vapor in the tank, as it is compressed by a rising liquid level, is useful for further sub-cooling the liquid. However, too much pressure in the tank is undesirable, as it reduces the amount of vapor that can be collected from vehicles once fueling begins. Therefore, the pressure is kept between a minimum pressure, usually the pressure under which the liquid in the tanker truck is placed, plus some additional desirable amount, and a maximum pressure. If the liquid pressure at the bottom of the tank is less than the minimum pressure, the cryogenic tank is filled from the bottom. As rising liquid level in the tank traps and compresses methane vapors, increasing the pressure beyond a predetermined maximum pressure, filling is switched to a spray bar at the top of the tank, which cools the vapor and collapses pressure. Once the liquid reaches a predetermined level, filling continues only from the bottom to avoid frequent cycling of the valves that divert the flow between the top and bottom of the tank. The maximum predetermined pressure is chosen so that continued filling of the tank will not cause the pressure to become undesirable high.

BRIEF DESCRIPTION OF THE DRAWINGS

FIGS. 4A, 4B and 4C are flow diagrams illustrating steps of a dispensing process of the fueling facility depicted in FIG. 1 and under the control of the programmable controller.

FIGS. 5A and 5B are steps, illustrated on a flow diagram, of an alarm process of the fueling facility depicted in FIG. 1 and under the control of a programmable controller.

DETAILED DESCRIPTION OF THE PREFERRED EMBODIMENT

Figure 1:
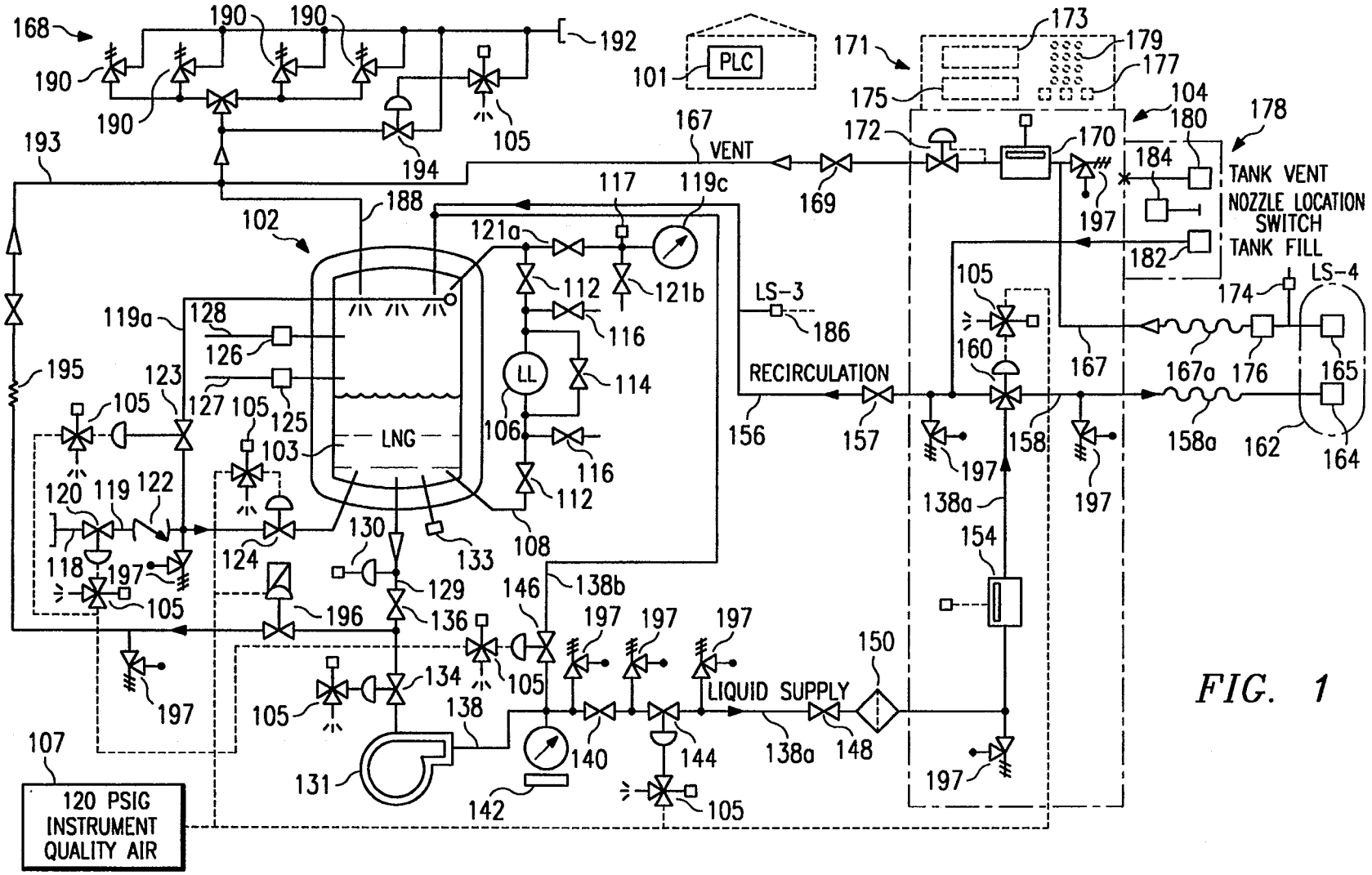
FIG. 1 is a schematic illustration of an automated liquified natural gas (LNG) fueling station.

Referring now to FIG. 1, a fueling station for liquid natural gas (LNG) or liquid methane includes a programmable controller 101 for automatically monitoring and controlling the condition of tank 102 and dispensing a supply of LNG 103 through dispenser 104. The programmable controller is located remotely from the tank and dispenser in a safe area such as a remotely located building. The controller includes a microprocessor and memory; digital and analog input circuits for receiving data from sensors and other types of transducers; digital and analog output circuits for communicating data and other signals that operate valves, motors, displays; and communication ports. Alternatively, any analog or digital computer or similar device may be adapted and used in place of a programmable controller. Signals carrying data are communicated to and from the controller via electrical lines. However, data may be transmitted using radio frequency, infrared, or optical signals.

Cryogenic storage tanks are well known and widely available. Generally, the tank is very well insulated and is not refrigerated. It is large enough to store a volume of LNG for refueling a fleet of vehicles for weeks or months. The tank is permanently placed on site and resupplied by tanker truck. However, the tank may be of a type that is transported to the fueling facility holding a supply of LNG and, when the LNG is depleted, replaced with a new tank of LNG.

The level of liquid in the tank is visually indicated by liquid level indicator 106. The level indicator is coupled through the bottom of tank 102 through line 108 and through the top of the tank through line 110. Manually operated valves 112 isolate the level indicator from the tank. Manually operated valve 114 equalizes the level indicator. Manually operated valves 116 are opened for bleeding the line on either side of the level indicator.

Pressure of the vapor in tank 102, as represented by the pressure of vapor in line 110, is remotely monitored by the controller 101 with pressure sensor 117. Pressure sensor 117 is a transducer that, like all other remotely monitored sensors shown in the system, transmits an electrical or optical signal over a line (not shown) or a radio frequency or infrared signal to the controller indicating the pressure. Pressure indicator **119*c* also provides a visual indication of pressure on the exterior of the tank. Manually operated valve 121*a* isolates the pressure sensor 117 and indicator 119*c* from line 110, and manually operated valve 121*b* relieves the pressure. The level of liquid in tank 102 is remotely monitored by the controller with level sensors 125 and 126 placed at different heights or levels in the tank. The level sensors transmit or provide a signal on lines 127 and 128 that indicates whether liquid is present at that level. Alternatively, the level of LNG in the tank can be remotely monitored by subtracting the pressure of the vapor indicated by pressure sensor 117 from the pressure indicated by pressure sensor 133** located at the bottom of the tank. The difference in pressure is due to the head of LNG. Knowing the specific gravity of LNG for the given temperature, the actual height of the head is then determined.

The supply of LNG in tank 102 is replenished through connection 118 designed to mate with a hose or line from a tanker truck. Pneumatically operated valve 120 opens to allow liquid to flow from connector 118 to fill line 119. Back-flow check valve 122 in fill line 119 prevents liquid from flowing out of tank 102. Fill line 119 branches to allow filling of the tank from the top or from the bottom, or both. Branch **119*a* is opened and closed with pneumatically operated valve 123, and branch 119*b* is opened and closed with pneumatically operated valve 124. Branch line 119*a*** terminates in a spray bar that sprays LNG into the top of the tank, cooling methane gas in the top of the tank and thereby lowering the pressure of the methane gas. Filling from the bottom keeps the LNG as cold as possible but displaces and compresses gas in the tank, requiring venting of gas. The controller controls the filling process.

Centrifugal pump 131 draws LNG from tank 102 through line 129 and pneumatically operated pump suction valve 134. The pump is preferably submerged in the LNG. The pump inlet can be isolated from line 129 using manually-operated pump suction isolation valve 136. Pressure sensor 130 is coupled to the bottom of tank 102 to measure the pressure of the liquid methane going into the pump inlet line 129. Temperature sensor 133 provides a signal indicative of the temperature of LNG 103 to the controller. Liquid is discharged from the pump's outlet through line 138. Valve 140 isolates the pump discharge. Pressure gauge 142 provides a visual display of pressure in discharge line 138.

Discharge line 138 branches into liquid supply line **138*a* and pump vent and cool-down line 138*b*. Pneumatically operated pump outlet valve 144 opens and closes liquid supply line 138*a* to regulate a flow of LNG to dispenser 104. Pneumatically operated valve 146 opens and closes line 138*b* to permit LNG to circulate from the bottom of tank 102 back to the top of tank 102 through pump 131. This circulation of LNG cools the pump and returns any methane vapor that may accumulate in the pump or discharge line 138 to the top. Furthermore, it helps to mix the LNG, which tends to form temperature stratifications. Manually operated valve 148 isolates dispenser 104 from supply line 138*a* so that the dispenser subsystem may be removed. Filter 150 filters LNG flowing through supply line 138*a* prior to being supplied to dispenser 104. The quantity of liquid flowing into dispenser 104 in supply line 138*a* is measured with liquid phase methane flow meter 154. The flow meter is preferably placed, however, in line 158 to achieve a more accurate measurement of methane actually dispensed into a vehicle. A PID loop, part of the controller, receives a signal indicating the flow rate measured by the flow meter. The PID loop feedbacks a signal to an input on an electric motor that drives pump 131 to change speed so as to provide a constant LNG flow rate to the dispenser 104** regardless of back-pressure on the liquid from a vehicle's fuel tank.

Once in the dispenser, the liquid in the supply line is diverted either to recirculation line 156, or fueling line 158 by pneumatically operated diverter valve 160. Instead of the three-way diverter valve shown, a two-way valve may installed on recirculation line 156. The recirculation line returns liquid methane to the massive storage tank 102. Valve 157 allows manual shut-off of the recirculation line. Fueling line 158 is connected through fueling line **158*a*, preferably a flexible hose, to nozzle 162** for manipulation and connection to a vehicle for fueling.

Nozzle 162 includes a connector valve 164 for preventing the flow of liquid until properly mated with a connector on the tank, and then sealing by means of a mating connector on a receptacle to the vehicle fuel tank. Nozzle 162 also includes a connector valve 165 for connecting vent line 167 to a fuel tank vent of a vehicle through a flexible hose portion **167*a***. A suitable nozzle is disclosed and described in copending and commonly assigned U.S. application, Ser. No. 07/973,159, filed Nov. 6, 1992 now U.S. Pat. No. 5,301,723, which application is hereby incorporated herein by reference.

Vent line 167 returns gaseous phase methane from a vehicle's fuel tank to the massive storage tank 102. Valve 169 permits manual closing of the vent line. Methane gas flow meter 170 measures the mass of the gas vented through vent line 167 in order to keep an accurate measurement of the amount of LNG actually dispensed into a vehicle's fuel tank. The value measured by the gas flow meter is transmitted to the programmable controller.

A back pressure valve 172, placed in vent line 167, maintains back pressure on gas flowing in the vent line at approximately the pressure under which a vehicle's tank is designed to be operated. For example, a fleet of vehicles may be outfitted with cryogenic fuel tanks and systems designed to be operated under 40 PSIG. The back pressure valve 172 is then set to 40 PSIG. As the vehicle's fuel tank fills during fueling, pressure in the tank is kept to a maximum pressure of 40 PSIG. Although most fleets have fuel tanks operated at uniform pressures, the LNG fueling facility preferably is capable of serving the individual vehicle or a fleet of vehicles with diverse fuel tank pressures. The back pressure valve is therefore variable and is set at the dispenser to match the tank pressure of the vehicle being fueled. The valve can be manually set, for example by entering some value on a keyboard or by turning a knob. Or, the back pressure valve can be automatically set by the controller 101. For automatic reading, the vehicle is fitted with an identification tag, encoded with the tank pressure and/or a vehicle identification code which can be matched to the tank pressure stored in a database associated with the programmable controller or with the data processing system. The identification tag is a physical configuration on the vehicle's fuel tank receptacle, a bar code, an integrated circuit, or a magnetic strip, which is read mechanically, optically, electrically, magnetically, or by using radio frequency signals, depending on the type of tag. The tag is preferably installed on a receptacle on a vehicle to which nozzle 162 is connected for refueling. An appropriate type of reader is installed in the nozzle, and data indicating the tank pressure is communicated to the controller and the controller then sets the back pressure valve 172.

A liquid sensor 174 is placed within the nozzle assembly or within vent line 167 for sensing the presence of liquid in the vent line, and for indicating that a vehicle's fuel tank is full and fueling should be shut off. Stopping fueling is important not only to prevent waste of LNG, but also, and more importantly, to prevent liquid from entering the gas flow meter 170. Liquid in the gas flow meter will render its measurements inaccurate and possibly cause damage to the gas flow meter. Once liquid is sensed, the controller shifts the diverter valve 160 from fueling line 158 to recirculation line 156 or it simply shuts off the pump.

Alternatively, or in combination with the liquid sensor if desired, a flow "velocity fuse" 176 is placed in the vent line or nozzle. The velocity fuse passes a flow of gas but immediately closes when liquid begins to flow past it. Velocity fuses are generally well known. Essentially, a velocity fuse includes a poppet valve that is biased to an open position. The biasing force is greater than frictional forces on the poppet caused by a flow of venting gas past that poppet at maximum fueling rates. The biasing force is, however, less than frictional forces generated by a flow of liquid past the poppet that can be expected when the tank is full. When the poppet closes, the flow of LNG is immediately halted, and the flow of venting gas past the gas flow meter 170 falls rapidly. The controller then stops fueling when the flow rate indicated by the gas flow meter 170 drops below a minimum threshold value. Fueling is stopped either by shifting the diverter valve 160 or turning off pump 131. Generally, the velocity fuse is preferred. Small amounts of liquid can usually be expected in the vent line, especially when several vehicles are fueled in rapid succession. The liquid sensor tends to be too sensitive to left over fuel in the nozzle or vent line and thus generates spurious indications of the presence of liquid.

When not connected to the vehicle, nozzle 162 remains connected to receptacle 178 on dispenser 104. Receptacle 178 is similar to a receptacle on a vehicle. However, vent line connector 180 is capped. Recirculation line connector 182 connects to fueling line connector 164 and thereby couples fueling line 158 to recirculation line 156, creating a LNG recirculation loop between the massive storage tank 102 and nozzle 162. When diverter valve 160 is shifted to fueling line 158, recirculating LNG cools fueling line 158, hose **158*a* and nozzle 162 to eliminate flashing of the LNG once fueling begins. This pre-cooling of the dispensing system prior to fueling helps to assure that saturated, heterogeneous liquid phase methane is dispensed into a vehicle. Sensor switch 184 communicates a signal to the controller 101 indicating whether nozzle 162 is connected to receptacle 178. Liquid sensor 186 transmits a signal to the controller indicating whether there is liquid in the recirculation line 156**. Liquid present at the liquid sensor indicates that cool-down is complete.

Dispenser 104 also includes a control panel 171. Visual display 173 shows total methane dispensed. Messages for directing a person who is dispensing LNG are written to visual display 175. A plurality of buttons 177 for starting and stopping the system, for pre-cooling and for starting and stopping fueling is provided. Keypad 179 provides for manual entry of data, such as vehicle identification, payment code, desired volume and/or vehicle tank pressure. The visual displays are written to by, and the buttons and keypad are inputs to, the programmable controller and are connected to the controller through a wiring harness running between the dispenser and the controller through buried conduits (not shown).

Venting system 168 vents gas from massive storage tank 102 through line 188. The venting system includes a plurality of safety relief valves 190 that vent gas through connector 192 when maximum allowed pressure is exceeded. Pneumatically operated valve 194 permits the controller to deliberately vent gas from the tank.

To build pressure on LNG 103 in the massive storage tank, LNG is passed via line 193 to heat exchanger 195. Heating the LNG vaporizes it into a gaseous state. The gas is then returned to the top of massive storage tank 102 through line 188. Line 193 includes a pressure regulating valve 196 that is active only when control system is overridden for manual control.

Each pneumatically operated valve has associated with it a three-way pilot valve 105 that is operated by electrical signals received from the controller 101. In one position, the pilot valve connects a supply 107 of instrument quality air under high pressure (120 PSIG) to the diaphragm on the main valve to switch open the main valve. In another position, the pilot valve vents air from the diaphragm, closing the main valve. A plurality of safety relief valves 197 are located throughout the system in appropriate locations to prevent excessive pressure build-up in the lines if liquid were to be trapped.

The programmable controller 101 is programmed to perform the processes illustrated in the flow diagrams of FIGS. 2–6. Submitted herewith as an appendix is a computer program listing written in a very high level graphical programming language for programming programmable controllers. The programming language is a control language, called "Cyrano", for use with Mistic Controller, sold by OPTO 22, Inc. of Tumecula, Calif. However, the use of Cyrano or a programmable controller to implement the processes is not to be construed as limiting the range of alternate implementations controlling the processes. Persons in the art will recognize that there are many alternatives. As previously discussed, any programmable computer can be used to execute a program of instructions for carrying out the processes. The program may be written in any higher level language that can be compiled to run on the chosen computer. Furthermore, dedicated hardware circuits may be substituted for the programmable computer.

Figure 2:
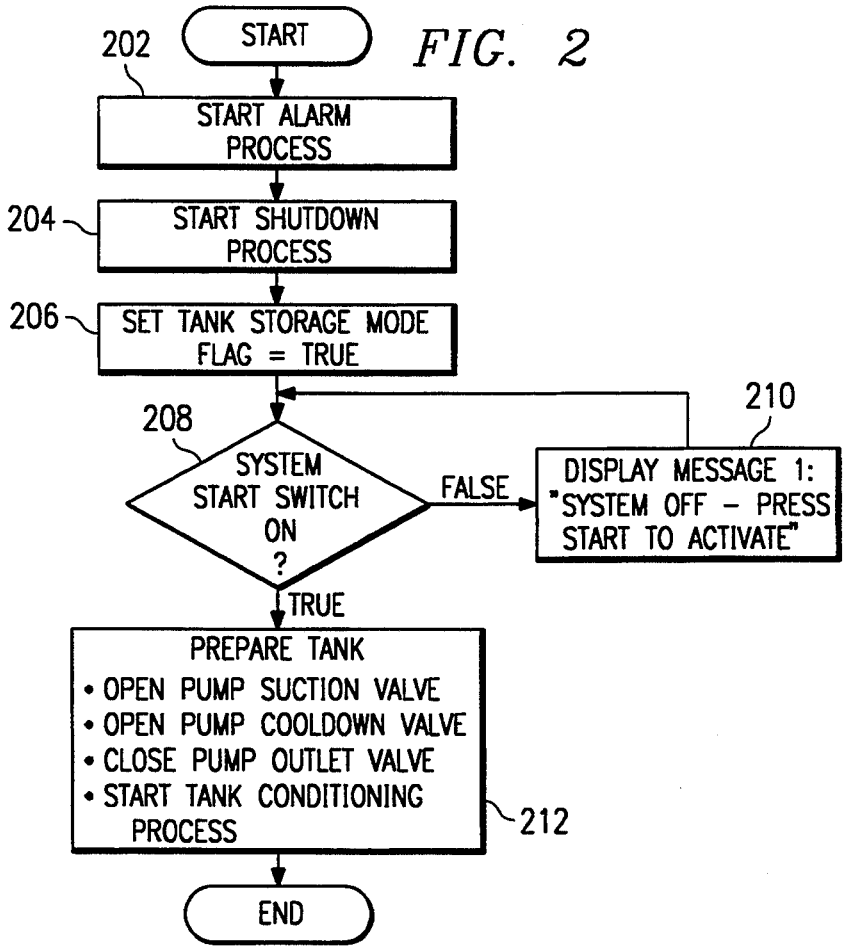
FIG. 2 is a flow chart illustrating the process steps of a programmable controller upon start-up of the fueling station of FIG. 1.

Referring now to FIGS. 1 and 2, when the programmable controller 101 is turned on, it automatically performs the steps outlined in the flow chart. At step 202, it starts an alarm process to immediately begin monitoring safety systems. A shut-down process is also enabled or "started", at step 204, to allow shut-down of the system at any time. Multiple processes may "run" on the programmable controller simultaneously. The programmable controller then sets a tank storage mode flag equal to true at step 206. This flag is used to remember that the tank is in a storage mode. The tank is in a storage mode when the system is powered up. The programmable controller then waits for a system start switch on the dispenser to be activated by a user, as indicated by decision block 208. If the system start switch is not pushed on, a message is written to message display 175 that the system is off and that the start button must be pressed to start the system, as shown by block 210, or as shown at step 201. Once the system start switch is pushed on by an operator, the tank is prepared for conditioning at step 212. Preparing the tank involves opening pump suction valve 134 and pump cool-down valve 146. Pump outlet valve 105 is closed so that all liquid that flows from the outlet of pump 131 flows through the cool-down loop formed by pump outlet branch **138*b***. A tank conditioning process is then activated, and the power up process ends.

Figure 3A:
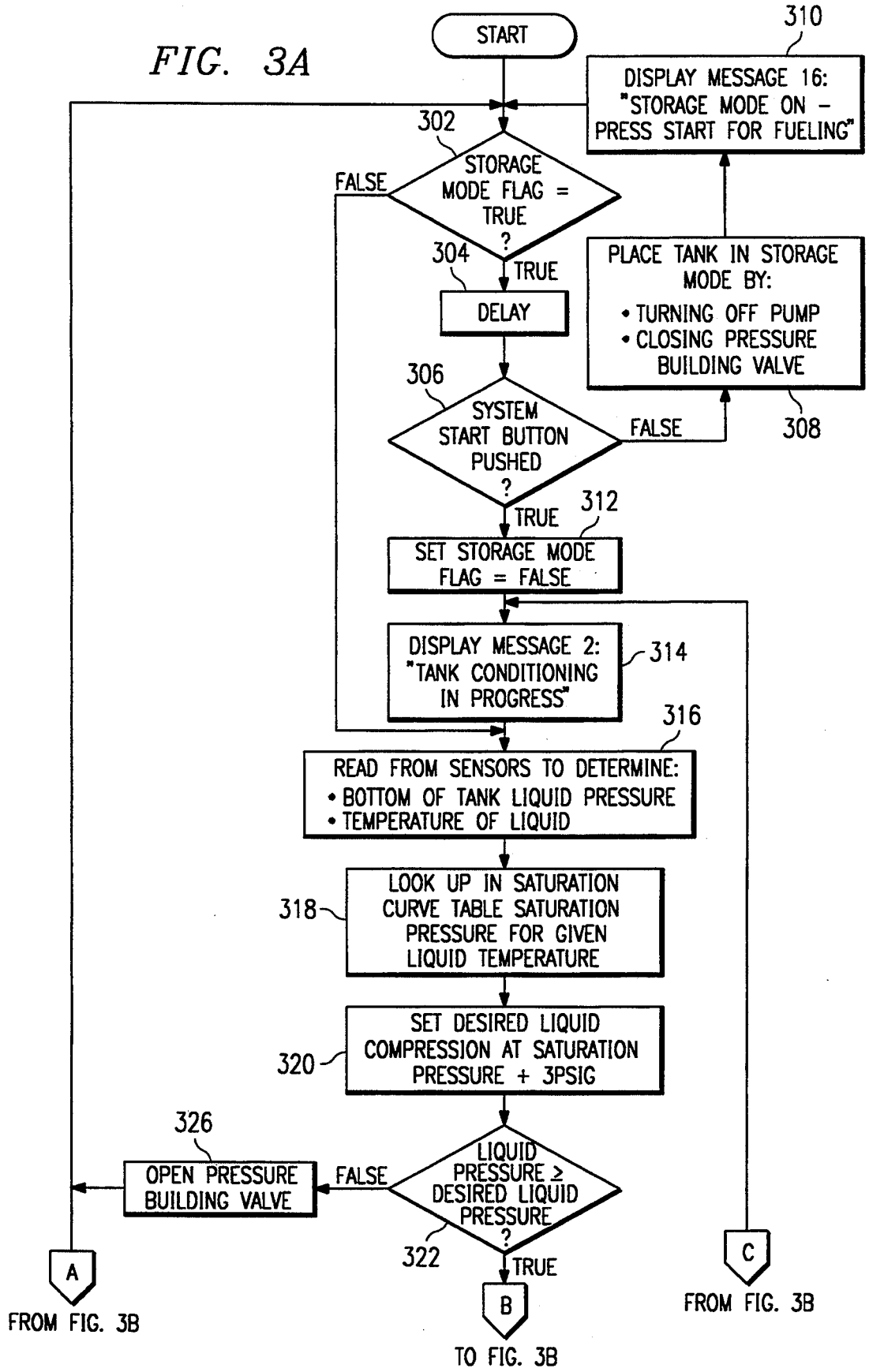
FIGS. 3A and 3B are steps, illustrated by flow chart, of a tank conditioning process in the fueling station of FIG. 1, under the control of the programmable controller.
Figure 3B:
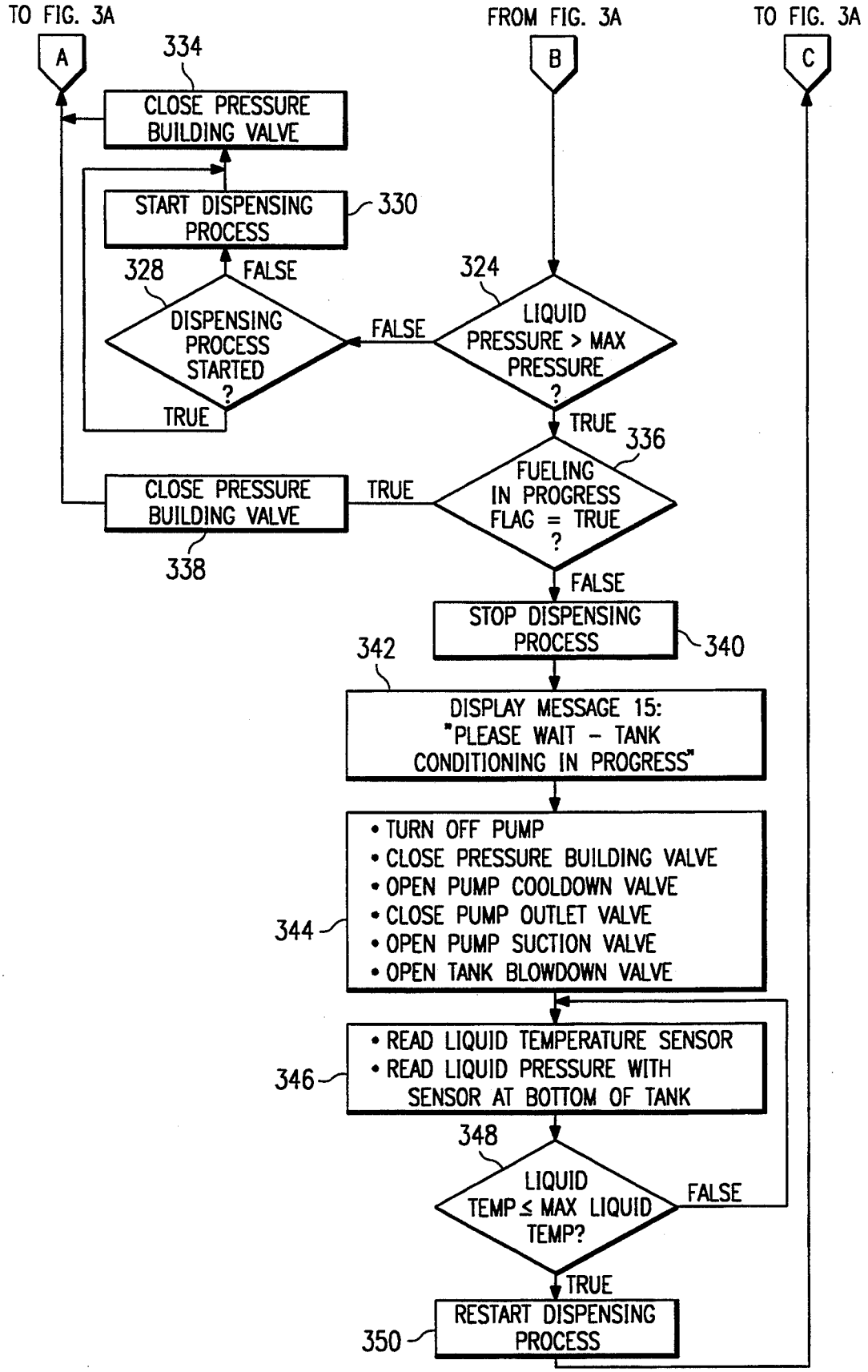

Referring now to FIGS. 1 and 3, a flow chart is depicted showing the tank conditioning process. The tank conditioning process steps will be described with reference to elements shown in FIG. 1. As indicated by decision block 302, if the storage mode flag is set to true, the programmable controller waits a predetermined period of time as indicated by delay step 304, and then checks to see if the system start button has been pushed. If the system start button has not been pushed, as indicated by decision branch 306, the tank is placed back into the storage mode by turning off pump 131 and closing pressure building valve 196, as described in step 308. At step 310, "Storage Mode On—Press Start for Refueling" is placed on message display 175, and the tank conditioning process is restarted. Once the system start button is pushed or turned on, as indicated by decision step 306, the storage mode flag is then set to false, as indicated by step 312, and a message written to message display 175 that "Tank Conditioning Is In Progress". The process then proceeds to step 316. If the storage mode flag was set to false at decision step 302, meaning the tank was not in storage mode, the tank conditioning process proceeds directly to step 316, where the tank conditioning begins.

As indicated by step 316, the pressure indicated by pressure sensor 130, which is the pressure of the LNG in the bottom of the tank, is read, as well as the temperature of the liquid at the bottom of the tank, as indicated by temperature sensor 133. The saturation pressure for the read LNG temperature is matched to a saturation pressure in a saturation curve table, as outlined in step 318. The saturation curve table is a listing of saturation pressures at discrete temperature intervals, as empirically determined and illustrated by well known phase charts for methane. Once saturation pressure is determined from the saturation curve table, a variable is set equal to the saturation pressure plus three PSIG for a minimum desired liquid pressure at the bottom of massive storage tank 102. The three PSIG "compression" compensates for line pressure losses and heating in piping leading to the intake of pump 131. This insures a saturated or slightly compressed fluid at the intake. Also, the three PSIG also assures that the pump has a positive net pressure at its intake, no matter the size of liquid head in the tank. The net positive pressure head on the pump will depend on the density of the liquid, which changes with the temperature. However, the variations in density of the liquid are small enough that they can be disregarded. Thus, the pump remains primed and no cavitation occurs that would result in the liquid flashing. The compression of the LNG will not necessarily be five PSIG for every system. Piping will differ. Also, the net positive pressure head will differ for each pump. The amount of compression will depend upon the particular pump used to pump the LNG. However, the amount of compression should not be set too high.

Decision steps 322 and 324 determine whether the liquid pressure at the bottom of the tank is between the desired liquid pressure and the maximum liquid pressure. If the liquid pressure is less than the desired liquid pressure, the tank conditioning process proceeds to step 326 to build pressure. Pressure building valve 196 is opened to flow LNG through heat exchanger 195 to heat LNG to a gaseous phase and increase the volume of the gas within the massive storage tank 102 and thereby compress the LNG. After the pressure building valve is opened, the tank conditioning process restarts. So long as the storage mode flag is set equal to false, steps 316, 318 and 320 are repeated and pressure is built up until the liquid pressure rises above the desired liquid pressure.

If the liquid pressure is greater than the desired liquid pressure and less than the maximum liquid pressure, the process proceeds to decision step 328. The dispensing process is started at step 330. Pressure building valve 196 is then closed at step 334. If the dispensing process has already begun, the tank conditioning process proceeds directly to step 334, closing the pressure building valve. At this point, the tank is in condition for dispensing. So long as the storage mode flag is set to false, steps 316, 318 and 320 are repeated and the liquid pressure is in effect continuously sampled to insure that it remains safely dispensing sub-cooled LNG within the prescribed operating range.

If the liquid pressure ever exceeds the maximum liquid pressure, indicating that the pressure within the massive storage tank 102 is unsafe, pressure in the tank must be relieved. At decision step 326, if the fueling in progress flag is set equal to true, meaning that fueling of a vehicle is occurring, the pressure building valve 138 is closed, as indicated by step 338. The tank conditioning process is then restarted as fueling continues. Continued fueling relieves pressure on the liquid by decreasing the volume of LNG 103 in massive storage tank 102 and expanding the volume of the methane gas. If the fueling in progress flag is false, the dispensing process is halted at step 340 and a message is displayed on display 175 to wait for tank conditioning, as indicated by step 342. At step 344, steps are taken to "blow-down" the massive storage tank 102. Pump 131 is turned off. Pressure building valve 196 is closed, if it has not already been closed. Pump outlet valve 144 is closed. Pump cool-down valve 146 and pump suction valve 134 are opened, if not already opened, to allow bleeding of gas from pump 131. Finally, tank blow-down valve 194 is opened to vent gas from massive storage tank 102.

At step 346, the liquid temperature sensor 133 is read. So long as the liquid temperature remains below the maximum allowed liquid temperature, blow-down continues. Once the maximum liquid temperature is reached, the dispensing process is restarted, as indicated by step 350, and the tank conditioning process is returned to step 314. Compression on the liquid is then brought back within the desired operating range as set out by steps 316–334.

Figure 4C:
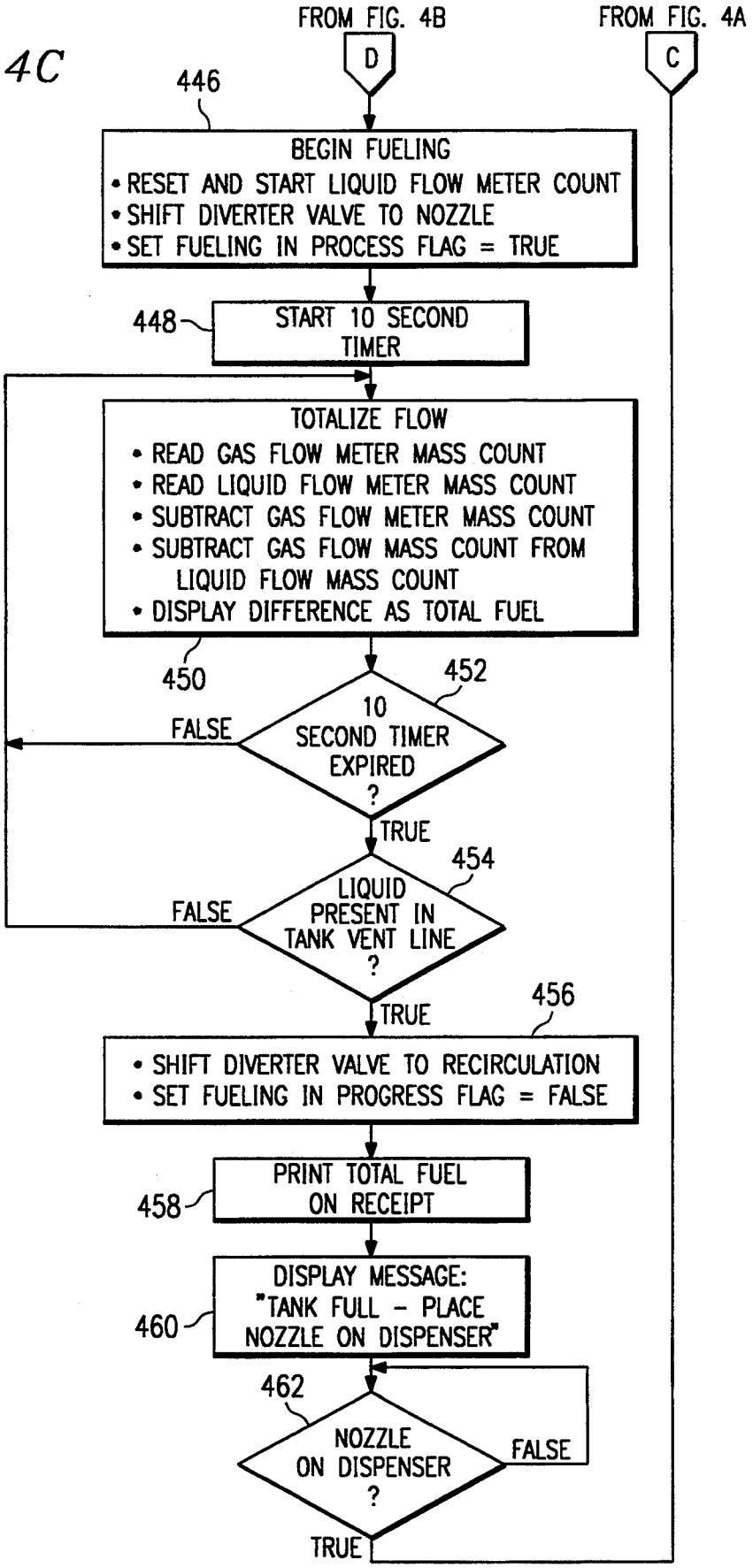

Referring now to FIGS. 1 and 4, once the tank is placed in condition for dispensing, the dispensing process is started. As indicated by decision steps 402 and 404, the nozzle 162 must be attached to dispenser receptacle 178 and a "cool-down" switch, one of a plurality of switches 177 on the dispenser, must also be on before the dispensing process can continue. If the nozzle is not attached to the receptacle on the dispenser, a message is written on display 175 to attach the nozzle to the dispenser, as indicated by step 406. Similarly, at step 408, if the cool-down switch has not been depressed, a message is displayed on display 175 to press the cool-down switch to continue the fueling process. If the cool-down switch is turned on and the nozzle is not attached to the dispenser, diverter valve 160 is shifted to recirculation line 156, as indicated by decision step 410 and 412. Once diverter valve 160 has been shifted to recirculation line 156, LNG is pumped from pump 131 through the liquid flow meter 154 and into recirculation line 156, to be returned to massive storage tank 102. Without the nozzle being attached to receptacle 178 on the dispenser 104, pre-cooling of the nozzle cannot take place. Therefore, a message to attach the nozzle to dispenser 406 is displayed once again, and the cool-down switch must once again be pressed.

Once the nozzle is attached to receptacle 178 and the cool-down switch is turned on, the pump 131 is activate diverter valve 176 is shifted to allow a flow of LNG from liquid supply line **138*a* to line 162 via line 158, as indicated by step 414. A message that cool-down is in progress is displayed on display 175, as indicated by step 416. During cool-down, LNG is pumped from the massive storage tank 102 by pump 131 through liquid supply line branch 138*a*, liquid phase flow meter 154, hose 158*a*, and connector 164 on nozzle 162, and then back through connector 182 on receptacle 178 and recirculation line 156 to the massive storage tank. At decision step 418, if liquid is not sensed by liquid sensor 186 in the recirculation line 156, a cool-down light is turned off, at step 420, indicating that the nozzle has not been cooled. Once liquid is sensed in the recirculation line 156, LNG has been circulated through nozzle 162. The nozzle is, therefore, cooled down. At step 422, the totalizer display 173 is blanked and reset to zero, and, as indicated at step 424**, the cool-down light is turned on, indicating that cool-down has been completed.

At step 426, the vehicle identification is entered manually using keypad 179 or buttons 177. Messages on display 175 prompt the user. Alternatively, vehicle identification may be automatically entered using an identification tag and a reader, as previously described. If the vehicle identification is invalid, as indicated by decision step 428, identification of the vehicle is re-entered or re-read. If valid, the dispensing process continues to fueling steps after printing the date and time on a receipt at step 430.

The process checks to see if the nozzle is still attached to the dispenser at decision step 432 by reading the position of transducer switch 184. If the nozzle is still attached to the dispenser, a message is written on display 175 to attach the nozzle to the vehicle, as indicated by step 434. Once the nozzle is removed from the dispenser, as sensed by transducer switch 184, prefueling step 436 is carried out. In the prefueling step, a two-minute timer is started, and diverter valve 160 is shifted to recirculation line 156. Totalizer display 173 is then blanked and the counts on the liquid flow meter 154 and gas flow meter 170 are reset. Back pressure valve 172 on vent line 167 is then set equal to the vehicle's tank pressure, as previously described. The tank conditioning process then enters a loop formed by decision steps 438 and 440 that waits for a fueling button, one of a plurality of buttons 177 on dispenser 104, to be pushed. If the fueling button is not on, a message is written on display 175 to press the fueling button to begin the fueling process. If the fueling process is not begun within two minutes, the cool-down steps, as indicated by decision step 440, in which LNG is circulated through nozzle 162 to cool it down, must be repeated. After the nozzle has been removed from the dispenser for more than two minutes, it is presumed to have warmed enough to possibly cause flashing of LNG when it is pumped. The two-minute period may be adjusted. However, the period should allow only enough time as is reasonable to permit attaching of the nozzle to the vehicle's fuel tank receptacle so that the possibility of flashing is minimized. Once the two-minute timer expires and the fueling button has not been pushed, the tank conditioning process returns to step 406, at which step a message is displayed to attach the nozzle to the dispenser. The dispensing process is then restarted.

If the fueling button is pushed within the prescribed two-minute period, a message, that fueling is in progress is written on display 175, as indicated by step 444. At step 446, fueling is begun by resetting and starting the count on the liquid flow meter 154, shifting the diverter valve 160 to the fueling line 158, and setting the fueling in progress flag equal to true. A ten-second timer is begun at step 448.

During fueling, as indicated by step 450, totalizer display 173 is updated by reading the gas flow meter mass count, reading the liquid flow meter mass count, and subtracting the gas flow mass count from the liquid flow mass count and displaying the difference as the total fuel dispensed on the totalizer display 173.

Fueling continues until at least ten seconds have passed, and there is no liquid present in tank vent line 167, as indicated by the loop formed by decision steps 452 and 454. Liquid in the vent line indicates that a vehicle's fuel tank is full. Liquid in the tank vent line is sensed, as previously described, with either a liquid sensor 174, or a velocity fuse 176 in combination with gas flow rates measured by gas flow meter 170. The ten-second timer is used to minimize the chance that the liquid sensor 174 senses LNG from a previous fueling left in vent line 167. The ten-second period may be altered as necessary to reduce spurious readings by the liquid sensor while providing cut-off protection to the gas flow meter.

Fueling is stopped at step 456 by shifting diverter valve 160 to recirculation line 156. As an alternative to step 456, pump 131 may simply be stopped instead of diverter valve 160 being shifted from fueling line 158 to recirculation line 156. Steps 414 and 446 would include turning on pump 131, if necessary, in addition to shifting the diverter valve from recirculation line 156 to fueling line 158. The fueling in progress flag is then set equal to false. The total amount of fuel is then printed on a receipt, step 458, and a message is written to display 175 that the tank is full. The operator is then instructed with a message written to display 175 to place the nozzle on the dispenser, as described in step 460.

Once the nozzle is placed on the dispenser, as indicated by condition step 462, the dispensing process returns to one of two places. If a stop button is pushed, indicating that dispensing of another vehicle is not expected, the dispensing process returns to the start, as indicated by decision step 464. Otherwise, if the stop button is not pushed, the dispensing process returns to decision step 418 to permit fueling to begin again without having to cool down the nozzle again. Fueling a vehicle cools the nozzle 162 as effectively as the cool-down steps. Therefore, cool-down does not need to be repeated if fueling will begin again within the prescribed two-minute period.

Referring now to FIG. 5, the alarm process continuously monitors a gas detector sensor, an external alarm, and an emergency stop switch, as indicated by a loop formed by decision steps 502, 504 and 506. If none of these are on or triggered, all audible and visual alarms are turned off, and the monitoring loop repeats. Otherwise, if the gas detector is on, a message is written to display 175 that the gas sensor has detected an unsafe level of gas, as indicated by step 510. Similarly, if an external alarm switch has been turned on, as indicated in step 512, a message is displayed that the external system alarm is on; and, if the emergency stop switch is pushed, a message is written to the display that the emergency stop alarm is on, as indicated by step 514. In an alarm condition, all processes are stopped, as indicated by step 516. The entire system is then shut down, as described in step 518, by putting it in a storage mode. Pump 131 is turned off and pump cool-down valve 146 is opened to allow LNG to flow through cool-down branch **138*b* back into massive storage tank 102. The pump outlet valve 144 is closed to prevent LNG from flowing to dispenser 104. Pressure building valve 196 is closed as well, as is pump suction valve 134 to prevent LNG from flowing from the massive storage tank 102. The tank storage mode flag is then set equal to true. At step 520**, visual and audible alarms are then turned on.

As indicated by a loop formed by decision steps 522, 524 and 526, the process again continuously monitors the gas detector, the external alarm, and the emergency stop button. Once all three are no longer active, the condition of the start switch is checked, at decision step 528. If the start switch is not on, a message is displayed on message display 175 to press the start button to reset the system, as shown by step 530. Once the start button is pressed, the power up process is started, as shown by step 532.

Figure 6:
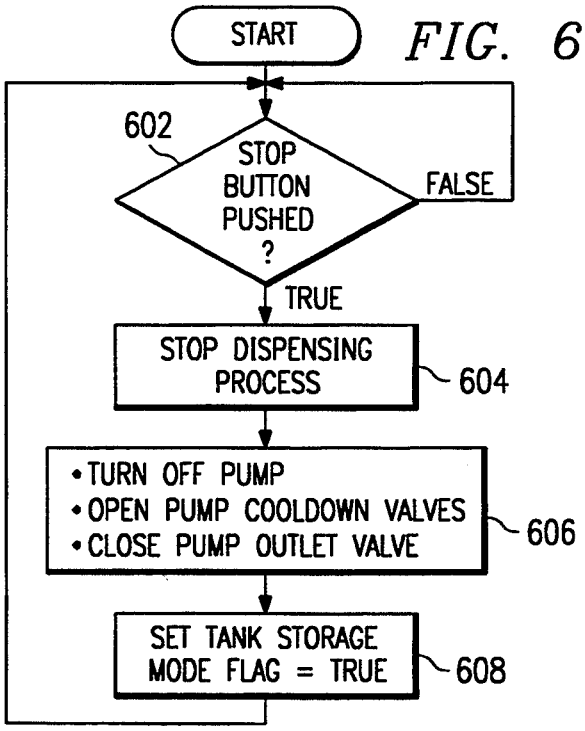
FIG. 6 is a flow diagram of the shut-down process of the fueling facility of FIG. 1 under the control of the programmable controller.

Referring now to FIG. 6, shutting down the LNG fueling system begins when a system stop button, one of the plurality of buttons 177 on dispenser 104, is pushed, as indicated by decision step 602. Once the stop button is pushed, the dispensing process is also halted, as indicated by step 604. The tank is placed in a storage mode as described in step 606 by turning off pump 131, opening pump cool-down valve 164, and closing pump outlet valve 144. The tank storage mode flag is then set equal to true, as indicated by step 608.

Although preferred embodiments of the invention have just been described and are illustrated in the accompanying drawings, it will be understood that the invention is not limited to the embodiments disclosed, but is capable of numerous rearrangements, modifications, and substitutions of pans and elements without departing from the spirit of the invention. Accordingly, the present invention is intended to encompass such rearrangements, modifications, and substitutions of pans and elements as fall within the scope of the invention as set forth in the appended claims.

What is claimed is:

1. A method of automatic operation of a facility for dispensing liquid methane into a motor vehicle through a dispenser system from a supply stored in a cryogenic storage tank comprising the steps of:

measuring pressure of the liquid methane near an outlet of a cryogenic tank with a pressure sensor and communicating a signal indicative of the pressure to a controller;

measuring temperature of cryogenic fluid near the outlet of the cryogenic tank with a temperature sensor and communicating a signal indicative of the pressure to the controller;

determining with the controller, in response to the signal indicative of temperature, a set pressure for the liquid methane, the set pressure substantially equal to a sum of a liquid saturation pressure for the liquid methane at the indicated temperature and an additional compression, the compression of the liquid methane being supplied by methane gas trapped in the cryogenic tank; and enabling the dispenser system to permit a user to dispense on demand liquid methane into a vehicle only if a signal from the pressure sensor indicates that the pressure of the liquid methane is substantially at or above the set pressure, thereby tending to assure that homogenous phase liquid methane is dispensed into a motor vehicle.

2. The method of claim 1 wherein the compression compensates at least partially for heat introduced by a pump that pumps liquid methane from the cryogenic tank.

3. The method of claim 1 further comprising the step of the controller communicating to a pressure building means in response to a signal from the pressure sensor indicating that the pressure of liquid methane is below the set pressure to build methane gas in the top of the cryogenic tank to compress the liquid methane to the set pressure.

4. The method of claim 1 further comprising the step of the controller opening a valve to vent methane gas from the cryogenic tank in response to a signal from the pressure sensor indicating that the pressure of the liquid methane is greater than a predetermined maximum.

5. The method of claim 4 wherein the step of enabling includes the step of the controller not enabling the dispenser system to begin dispensing if a signal from the pressure sensor indicates that the pressure of the liquid methane is above the predetermined maximum pressure.

6. The method of claim 5 further including the controller opening a venting system to relieve pressure within the tank by venting methane gas in response to a signal from the pressure sensor indicating that the pressure of the liquid is above the predetermined maximum pressure; wherein the step of enabling includes the controller not enabling the dispenser system to begin dispensing during venting of the methane gas.

7. A facility for selectively dispensing cryogenic liquid from a massive storage tank comprising:

a massive storage tank for storing a supply of cryogenic liquid;

a nozzle for dispensing small quantities of cryogenic fluid from the massive storage tank into a second storage tank;

a pump for pumping cryogenic fluid from the massive storage tank to the nozzle;

a recirculation receptacle disposed in proximity to the nozzle adapted to receive the nozzle when cryogenic fluid is not being dispensed into a second storage tank; the receptacle being coupled by a return line to the massive storage tank to thereby form a recirculation loop for allowing flow of cryogenic fluid from the massive storage tank through the nozzle and back to the massive storage tank to cool the nozzle when the nozzle is mated with the receptacle prior to dispensing.

8. The facility of claim 7 further including a controller for assuring that the nozzle is cool prior to dispensing, the controller not allowing the facility to dispense cryogenic fluid through the nozzle if the cryogenic fluid does not first circulate through the nozzle and the receptacle.

9. The facility of claim 8 wherein the controller prompts a user to cool the nozzle prior to dispensing.

10. The facility of claim 7 further including a liquid sensor between the nozzle and the massive storage tank in the recirculation loop, the controller receiving a signal indicating the presence of liquid and, in response thereto, allowing dispensing to take place.

11. The facility of claim 7 further including a controller for assuring that the nozzle is cool prior to dispensing and a nozzle sensor on the recirculation receptacle for indicating to the controller whether the nozzle is on the receptacle; wherein, after cryogenic fluid has been recirculated through the nozzle, the controller allows, in response to the nozzle sensor indicating that the nozzle has been removed from the recirculation receptacle, the facility to begin to dispense only within a period that the nozzle is likely to remain substantially cool so as to reduce the possibility of the cryogenic fluid flashing when dispensing begins.

12. The facility of claim 11 wherein the controller prompts a user to reattach the nozzle to the recirculation receptacle after the period expires.

13. The facility of claim 7 further including:

means for selectively allowing flow of cryogenic fluid through the nozzle;

a nozzle sensor for providing a signal to the means for selectively allowing flow of cryogenic fluid for indicating whether the nozzle is coupled for recirculation to the recirculation receptacle;

a liquid sensor between the nozzle and the massive storage tank in the recirculation loop for providing a signal to the means for selectively allowing flow of cryogenic fluid for indicating the presence of liquid;

user-operable means for indicating with a first signal to the means for selectively allowing the flow of cryogenic fluid to begin cooling of the nozzle and with a second signal to begin dispensing;

wherein the means for selectively allowing flow of cryogenic fluid allows flow of cryogenic fluid to the nozzle in response to receiving the signal from the nozzle sensor indicating that the nozzle is on the recirculation receptacle and the first signal from the user-operated means to begin cooling of the nozzle; and wherein, when the nozzle is not coupled to the recirculation receptacle, the means for selectively allowing flow of cryogenic fluid allows a flow of cryogenic fluid to the nozzle in response to the second signal from the user-operated means received substantially within a prescribed period of time following receiving the signal from the liquid indicating that there is liquid in the recirculation loop and receiving a signal from the nozzle sensor that the nozzle has been uncoupled from the recirculation receptacle.

14. The facility of claim 13 wherein the means for selectively allowing includes a controller for turning the pump on and off.

15. The facility of claim 13 wherein the means for selectively allowing flow of cryogenic fluid includes a valve for diverting a flow of cryogenic fluid from the pump away from the nozzle and to the return line.

16. The facility of claim 7 further including means for visually indicating prompts to a user to place the nozzle on the recirculation receptacle and how to operate the user-operated means to begin cooling of the nozzle and to begin dispensing.

17. A system that dispenses fuel as a cryogenic liquid for accurately measuring the mass of fuel dispensed into a tank, the system having a dispensing line for coupling to an inlet of a tank, through which liquid flows into the tank, and a vent line for coupling to a vent outlet of the tank for, through which vapor displaced from the tank flows, the system including an apparatus for terminating liquid flow into the tank when the tank is full including:

a liquid flow meter for sensing the mass flow rate of the cryogenic liquid through the dispense line for calculation of the total mass of fuel dispensed into a tank;

a vapor flow meter for sensing the mass flow rate of vapor through the vent line for determining the mass of fuel displaced from the tank during dispensing;

an apparatus for calculating the total amount of fuel dispensed into and retained in the tank from information provided by the liquid flow meter and the vapor flow meter; and a valve in the vent line that is biased open, wherein a flow of vapor at rates expected during dispensing exert insufficient force to close the valve and a flow of liquid through the vent line when the tank is full exerts a force sufficient to close the valve, the closing of the valve closing the vent line to a flow of vapor and liquid through the vent line.

18. The system of claim 17 wherein the system stops dispensing after the liquid flow meter senses a liquid flow rate through the dispensing line that is substantially less than the rate expected during normal tank filling, indicating that the valve in the vent line has closed.

19. The system of claim 18 further including a controller coupled to the liquid flow meter and the vapor flow meter for enabling and disabling dispensing, wherein the controller waits a predetermined period of time after initiation of liquid flow before terminating flow of liquid in response to the vapor flow meter indicating that liquid flow has substantially dropped.

20. The system of claim 17 where in the system stops dispensing of fuel after the vapor flow meter senses a vapor flow rate through the vent line substantially less than a rate expected during normal tank filling and indicating that the valve in the vent line has closed.

21. The system of claim 20 further including a controller coupled to the liquid flow meter and the vapor flow meter for enabling and disabling dispensing, wherein the controller waits a predetermined period of time after initiation of liquid flow before terminating flow of liquid in response to the vapor flow meter indicating that liquid flow rate has substantially dropped.

22. The apparatus of claim 17 wherein the controller terminates flow of liquid by diverting the flow of liquid away from the dispensing line to a return line.

23. The apparatus of claim 17 wherein the controller terminates the flow of liquid by turning off a pump delivering liquid under pressure to the dispensing line.

* * * * *